US005821686A

United States Patent [19]

Nomura et al.

[11] Patent Number: 5,821,686

[45] Date of Patent: Oct. 13, 1998

[54] INNER-SHIELD MATERIAL TO BE ATTACHED INSIDE A COLOR CATHODE RAY TUBE

[75] Inventors: Giichiro Nomura; Osamu Yubuta, both of Kudamatsu, Japan

[73] Assignee: Tokyo Kohan Co., Ltd., Tokyo, Japan

[21] Appl. No.: 773,006

[22] Filed: Dec. 24, 1996

Related U.S. Application Data

[62] Division of Ser. No. 392,618, Feb. 22, 1995, abandoned, which is a continuation of Ser. No. 91,683, Jul. 15, 1993, abandoned.

[30] Foreign Application Priority Data

Jul. 16, 1992 [JP] Japan ..... 4-213309

[51] Int. Cl.[6] ..... H01J 31/00

[52] U.S. Cl. ..... 313/479; 313/402; 313/405

[58] Field of Search ..... 313/402, 405, 313/479; 148/530, 534

[56] References Cited

U.S. PATENT DOCUMENTS

| | | | |
|---|---|---|---|
| 2,115,750 | 5/1938 | Rubin et al. . | |
| 3,006,782 | 10/1961 | Wheildon, Jr. . | |
| 3,095,361 | 6/1963 | Stone et al. . | |
| 4,292,565 | 9/1981 | Kanto . | |
| 4,385,256 | 5/1983 | Tokita et al. | 313/407 |
| 4,665,338 | 5/1987 | Inaba et al. . | |
| 4,775,599 | 10/1988 | Matsuoka et al. . | |
| 5,094,920 | 3/1992 | Shiozaki et al. . | |
| 5,252,151 | 10/1993 | Inoue et al. . | |

FOREIGN PATENT DOCUMENTS

| | | |
|---|---|---|
| 57-5239a | 12/1982 | Japan . |
| 59-53682 | 3/1984 | Japan . |
| 59-105243 | 6/1984 | Japan . |
| 60-21331 | 2/1985 | Japan . |
| 61-3472 | 1/1986 | Japan . |
| 61-39344 | 2/1986 | Japan . |
| 61-235594 | 10/1986 | Japan . |
| 62-15733 | 1/1987 | Japan . |
| 62-73531 | 4/1987 | Japan . |
| 62-238003 | 10/1987 | Japan . |
| 2280329 | 12/1987 | Japan . |
| 6115393 | 1/1989 | Japan . |
| 641894 | 1/1989 | Japan . |
| 2-25201 | 1/1990 | Japan . |
| 225201 | 1/1990 | Japan . |
| 261029 | 3/1990 | Japan . |
| 2197301 | 8/1990 | Japan . |
| 2270248 | 11/1990 | Japan . |
| 3166388 | 7/1991 | Japan . |

OTHER PUBLICATIONS

Merriman, A Dictionary of Metallurgy, (1958), p. 278.

*Primary Examiner*—Vip Patel
*Attorney, Agent, or Firm*—Browdy and Neimark, P.L.L.C.

[57] ABSTRACT

The present invention provides both inner shield materials and its manufacturing method with superior magnetic characteristics and rust protection, which does not require conventional blackening process. Another object of the present invention is to provide the inner-shield manufacturing method, by which steel sheet or strip passing is smoothed in the plating process and Ni-plated steel sheet or strip is prevented from sticking in the annealing process.

1 Claim, 1 Drawing Sheet

INNER-SHIELD MATERIAL TO BE ATTACHED INSIDE A COLOR CATHODE RAY TUBE

This is a division of abandoned application Ser. No. 08/392,618, filed Feb. 22, 1995, which is a continuation of application Ser. No. 08/091,683, filed Jul. 15, 1993, now abandoned.

BACKGROUND OF THE INVENTION

1. Field of the Invention

The present invention relates to an inner-shield material to be attached inside a color cathode ray tube and its manufacturing method, especially to the manufacturing method for the inner-shield material having superior magnetic characteristics and rust protection or corrosion resistance that eliminates a blackening process in and its manufacturing method.

The magnetic shield material for a color cathode ray tube is attached to an outer or inner side of the color cathode ray tube to prevent electron beams from being deflecting by terrestrial magnetism. The magnetic shield material attached inside the tube is referred to as an inner shield material, while that outside the tube is referred to as an outer-shield material. In addition to such magnetic characteristics as higher permeability and lower coercive force, the characteristics on thermal radiation and rust protection are required for the magnetic-shield material.

For this purpose, for example, in Japanese Patent Publication No. 1894 of 1989 (hereafter referred to as "the former reference"), the use of Ni- or Cr-plated steel sheet or strip as inner-shield materials and the technique for blackening the surface of the plated steel sheet or strips in the heat treatment on the color cathode ray tube manufacturing process have been disclosed. However, this technique is only for manufacturing color cathode ray tubes, it could not be extended to manufacturing inner-shield materials. On the other hand, TOKU KAI HEI 2 (Japanese Unexamined Patent Publication 1990) 228466 (hereafter referred to as "the latter reference") disclosed a technique for forming a blackened film or coat with FeO contained as its main constituent on the surface of a thin steel sheet or strip using an oxidizing gas and a non-oxidizing gas in a continuous annealing line in an inner-shield material manufacturing process. The latter reference mentioned that this technique could eliminate the blackening process in the manufacture of color cathode ray tube.

The former reference suggests that the use of Ni- or Cr-plated steel sheet or strips may eliminate the blackening process which has been necessary for conventional non-plated steel sheet or strip. In effect, some manufacturers use ultra-thin Cr-plated steel sheet or strips as an inner-shield material.

Usually, however, the ultra-thin Cr-plated steel sheet or strips described in the former reference are produced through a sequential processes of annealing, skin pass rolling, and plating. Thus, ultra-thin Cr-plated steel sheet or strip have the disadvantage of inferior magnetic characteristics inasmuch as the grains of the annealed steel sheet or strip are distorted by the skin pass rolling. It was found that these magnetic characteristics by themselves could be improved by modifying the manufacturing process to use the sequential processes of plating and annealing. However, nobody has used this process because of some difficulties in the plating step following after annealing as disc used below.

That is to say, the material, prior to being subjected to the plating process, has been softened through the annealing process, and moreover, its thickness is very thin (in general, steel sheet or strips with a thickness of 0.15 mm are used).

Thus, the material cannot be passed through the plating process because of the so-called "wrinkle" on its surface. Or even when it may pass through the process, the material is so deformed that it is unusable as an inner-shield material.

On the other hand, the method described in the latter reference is considered to be better than that the method in the former described reference with respect providing good magnetic characteristics.

The blackening is executed in the continuous annealing furnace in accordance with the following steps.

① Heating Process

Forming $Fe_3O_4$ in an oxidizing gas

② Soaking Process

Transforming $Fe_3O_4$ into FeO in a non-oxidizing gas

③ Cooling Process

Rapidly cooling the steel sheet or strip in the non-oxidizing gas atmosphere to form the blackening film containing FeO as the principal constituent This method is a new technique for improving the blackening film's adhesion by transforming the $Fe_3O_4$ having inferior adhesion to the material into FeO, which can eliminate the blackening process in color cathode ray tube manufacture.

The latter reference, however, suggests the following.

a) The heating pattern and the gas atmosphere should be strictly controlled to form a blackening film, which can withstand to the press forming process.

b) The blackening film containing FeO as a principal constituent should be formed on the surface of the material under strictly controlled conditions.

These suggestions mean that in the method of the latter reference, it is likely that $Fe_3O_4$ with inferior adhesion may be occasionally formed.

Thus, in the latter reference, some manufacturing and quality assurance problems exist because $Fe_3O_4$ with inferior adhesion might be produced, if strict control over manufacturing conditions is not maintained.

The object of the present invention is to provide both an inner-shield material and with superior magnetic characteristics and rust protection and a method for its manufacture, which does not require a conventional blackening process.

Another object of the present invention is to provide an inner-shield manufacturing method, by which steel sheet or strip passing is made smooth in the plating process and Ni-plated steel sheet or strip is prevented from sticking in the annealing process.

SUMMARY OF THE INVENTION

To achieve the above objects, the present invention provides an inner-shield material (aluminum-killed, cold rolled steel sheet or strip with a specified surface roughness), which has a nickel-iron diffusion layer on at least on side and a nickel layer over the nickel-iron diffusion layer.

Further, the present invention provides a method for manufacturing an inner-shield material which is provided by processing low-carbon, aluminum-killed steel strip sequentially through the steps of acid pickling, cold-rolling, Ni-plating and annealing.

Thus, this annealing of the Ni-plated steel sheet or strip adjusts the grains of the material and greatly improves the magnetic characteristics of the inner-shield material.

In addition, cold-rolling the steel sheet or strip before Ni-plating facilitates the steel sheet or strip passing in the Ni-plating process and prevents the Ni-plated steel sheet or strip from sticking in the annealing process.

According to the present invention, another method for manufacturing the inner-shield material is provided by passing the steel sheet or strip sequentially through the processes of acid pickling, primary cold-rolling, annealing, secondary cold-rolling, Ni-plating, and re-annealing.

Thus, annealing between the primary and secondary cold-rolling steps greatly improves the magnetic characteristics of the material.

DESCRIPTION OF THE PREFERRED EMBODIMENTS

Figures 1, 1A:
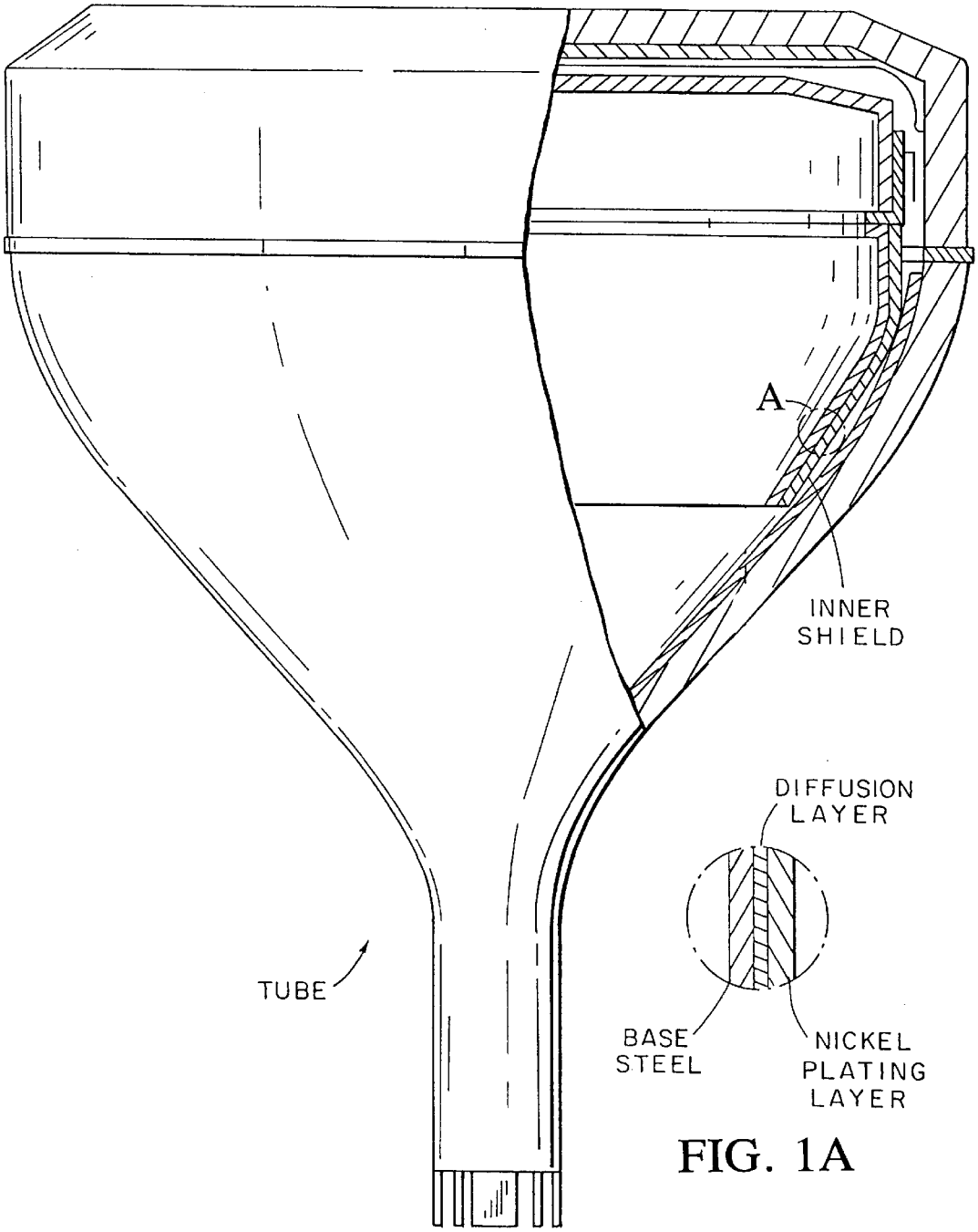
FIG. 1 is a cross sectional view of a cathode ray tube showing an inner shield.
FIG. 1A is an enlarged view of area A in FIG. 1.

The manufacturing method used for inner shield materials involves the step of cold-rolling aluminum killed cold-rolled steel sheet or strip with the surface roughness of 0.2–2.0 μm Ra, the step of surface-treatment for depositing a nickel layer with a thickness of 0.1–5.0 μm on at least one side of said steel sheet or strip, and the step of annealing said surface-treated steel sheet or strip.

The details of preferred embodiments of the method of the present invention are described hereinafter.

1. Acid Pickling

Before the cold rolling process, the base steel is preferably processed to an acid pickling in order to eliminate hot band scales in the acid solution. In this case, sulfuric or hydrochloric acid is preferably used.

Note that to facilitate the elimination of scales, a method for cracking scales on the surface of the hot band using any means such as a scale breaker located at the entrance of the line can be used simultaneously.

2. Cold-Rolling Process

The hot band are continuously cold-rolled to approximately the given thickness by a continuous cold rolling mill.

The dull surface roll can be used to dull the surfaces of the steel sheet or strip to adjust their surface roughness during cold-rolling. The transcription rate from the roll to the strip is about 10–20%. In this case, palm oil is used as a rolling oil. In this process, the steel sheet or strip should be checked for steel thickness, surface defects, and shape. Whale oil or tallow based synthetic oil can be also used as the rolling oil.

After rolling, the steel sheet or strip are electrolytically degreased in a solution such as sodium orthosilicate in order to remove the rolling oil.

To enhance the degreasing ability of the solution, some surfactant can be added.

Note that to increase the degreasing ability in the cleaning process the steel sheet or strip are preferably used as an electrode in the bath. In this case, $H_2$ and $O_2$ generated on the steel strip surface act to separate the rolling oil mechanically from the steel surface.

3. Skin Pass Rolling Process

According to the method claimed in the present invention, the surface roughness can be adjusted in the cold-rolling step, or in the skin pass rolling step following cold-rolling.

Generally, in the surface treatment of the steel sheet or strip manufacturing process, annealing is usually followed by skin pass rolling to prevent from fluting, stretcher strain, to flat the shapes of the strip, and to print surfaces roughness.

In general, the steel sheet or strip is cold-rolled a little at the rolling reduction of approximately 0.5~3.0% in the drying process without using a rolling oil.

However, according to the method claimed in the present invention, the steel sheet or strip is skin pass-rolled after the steps of cold-rolling and cleaning.

In addition, dulling the surfaces of the steel sheet or strip prevents the strip from sticking and prevents flaws from appearing on the surfaces during annealing.

4. Ni-Plating Process

The surface of the steel sheet or strip is cleaned and activated through the steps of degreasing and acid cleaning, and then Ni-plated.

In the present invention, Ni-plating is applied because of its superior rust protection and its characteristic of not affecting the intrinsic magnetic properties of the steel sheet or strip.

In addition, the Ni-plated steel sheet or strip has a benefit in that the blackening process in cathode ray picture tube manufacture can be eliminated.

In Ni-plating, a nickel-sulfate bath (so-called Watt bath) is usually used. Other ordinary Ni-plating baths, however, such as a nickel chloride bath or sulfamine acid bath, etc. can also be used.

Note that according to the present invention, the thickness of the Ni-plating is thinner than those applied in conventional nickel plating.

A nickel anode is a nickel pellet contained in a titanium basket wrapped in a synthetic-fiber bag. Slime or sludge is thus prevented from being in suspension.

Any suspension in the plating bath causes a projection on the surface or pinholes in the plating layer as a result of co-deposition. To eliminate such a suspension, the plating solution is always circulated through a filter.

To achieve higher corrosion resistance, a thicker layer of Ni-plating is usually applied to the surface of the steel sheet or strip.

However, the means outlined above enables a thinner layer of Ni-plating to provide high corrosion resistance.

Thus, a Ni-plating layer with a thickness between 0.1–5.0 μm can be applied. Note that a thickness greater than 5.0 μm is considered to be uneconomical.

5. Annealing Step

In the annealing step, the Ni-plated steel sheet or strip are box-annealed to facilitate re-crystallization and grain growth of the steel sheet or strip, and to improve the magnetic characteristics.

$H_2$ and $N_2$ gases are flowed into the furnace to prevent Ni plating layer from discoloration as a result of oxidization.

The steel sheet or strip should be annealed in the furnace at 580° C.–620° C. for five to eight hours. In this process the rolling texture made in the cold rolling step is recrystallized and the grains are grown. This heat treatment achieves higher maximum magnetic permeability μm, and a lower coercive force Hc.

In the process, moreover, the recrystallized grains and the Fe-Ni diffusion layer are formed in the Ni plating layer to enhance toughness, adhesion, and corrosion resistance.

Note that to avoid sticking between steel sheet or strip to each other during the annealing process, a proper annealing temperature and length of time are selected. Moreover the surface of the steel sheet or strip is dulled by cold-rolling or skin pass rolling, and the coiling tension is adjusted.

The third aspect of the present invention is basically similar to the second aspect of the present invention with the exception that the steel sheet or strip is annealed, and is re-annealed after the Ni-plating process.

The inner-shield material is thus produced through the sequential steps of acid pickling, primary cold-rolling, annealing, secondary cold-rolling, Ni-plating, and re-annealing.

Only those points of difference are described below.

(1) Primary Cold-Rolling

The primary cold-rolling is generally similar to said cold-rolling in the second aspect of the present invention. Note that the thickness of the produced steel sheet or strip may be 20–50% thicker compared with the thickness in the second aspect of the present invention.

(2) Annealing Step

In the embodiment in the third aspect of the present invention, the steel sheet or strip is annealed between the primary cold-rolling step and second cold rolling step. This annealing step is closely related to the post-process of secondary cold-rolling, and if necessary, to skin pass rolling.

Pre-annealing before the secondary cold-rolling step thus reduces rolling reduction substantially to grow larger grains during re-annealing and to enhance the magnetic characteristics of the material.

(3) Secondary Cold-Rolling

This process is basically similar to the second aspect of the invention except that the steel sheet or strip is rolled into the final thickness. However, care should be taken of the shape and thickness of the steel sheet or strip during cold-rolling, because these properties affect product quality directly.

(4) Re-Annealing

In the third aspect of the present invention, the steel sheet or strip is re-annealed. In the second aspect of the present invention, 2.3 mm hot band is cold-rolled to 0.15 mm thickness. In this case, 93.5% of the higher rolling reduction is applied.

The higher rolling reduction causes to be formed smaller after annealing and inferior magnetic characteristics.

In the third aspect of the present invention, the annealing and secondary cold-rolling step are added to reduce the final rolling reduction to 20–50%. This lower rolling reduction causes larger grains to be formed after re-annealing.

Compared with the second aspect of the present invention, the re-annealing and secondary cold rolling steps are added to this third aspect of the present invention.

These processes make the lower cold reduction possible in the secondary cold-rolling step that precedes the re-annealing step and results in larger grains of the final product following the re-annealing step.

Note that the annealing furnace and gas atmosphere are the same as those in the second aspect of the present invention.

Example (1) Composition

The inner-shield material has been produced through the processes outlined below using a low-carbon aluminum-killed steel containing the compositions shown in Table 1.

TABLE 1

| Composition (wt %) | C | Si | S | Mn | P |
|---|---|---|---|---|---|
| Example | 0.0045 | 0.005 | 0.005 | 0.24 | 0.013 |

(2) Manufacturing Process (Acid Pickling)

Hot band scales were removed in hot sulfuric acid. To facilitate the scale-removing, scales on the surfaces was cracked using a scale breaker at the entrance of the pickling line.

(Cold-Rolling)

2.3 mm thick hot band steel sheet of strip was cold-rolled into the thickness of 0.15 mm using a continuous cold rolling mill.

Palm oil was used as the rolling oil and care was taken with regard to steel thickness, surface defects and shape.

(Cleaning)

To remove the rolling oil, the rolled-steel sheet or strip was electrolytically degreased in a bath such as the sodium orthosilicate solution. The temperature of the bath was 80° C.–100° C. A surfactant was added to the bath to enhance its degreasing ability.

(Skin-Pass Rolling)

The steel sheet or strip with different surface roughness was produced through the skin-pass rolling process at an approximate 0.5% rolling reduction. The results are listed in Tables 2 and 3.

TABLE 2

| Sample No. Example | Surface roughness Ra (μm) | Sticking in annealing | Ni plating thickness (μm) | Ni plating Corrosion resistance | Magnetic characteristics Br (KG) | Hc (Oe) | max. permeability | evaluation |
|---|---|---|---|---|---|---|---|---|
| 1 | 0.21 | ○ | 0.42 | ◎ | 12.1 | 1.29 | 4215 | ◎ |
| 2 | 0.28 | ○ | 1.00 | ◎ | 12.5 | 1.31 | 4307 | ◎ |
| 3 | 0.42 | ○ | 0.10 | ○ | 12.9 | 1.34 | 4316 | ◎ |
| 4 | 0.44 | ○ | 0.20 | ◎ | 12.6 | 1.30 | 4382 | ◎ |
| 5 | 0.47 | ○ | 2.50 | ◎ | 12.0 | 1.34 | 4022 | ◎ |
| 6 | 0.56 | ○ | 5.00 | ◎ | 12.1 | 1.33 | 4271 | ◎ |

TABLE 3

| Sample No. Comparative Example | Surface roughness Ra (μm) | Sticking in annealing | Ni plating thickness (μm) | Ni plating Corrosion resistance | Magnetic characteristics Br (KG) | Hc (Oe) | max. permeability | evaluation |
|---|---|---|---|---|---|---|---|---|
| 9 | 0.10 | × | 0.20 | ◎ | 12.3 | 1.36 | 4311 | ◎ |
| 10 | 0.18 | × | 0.10 | ◎ | 12.4 | 1.38 | 4298 | ◎ |
| 11 | 0.45 | ○ | 0.08 | × | 6.9 | 2.30 | 1605 | × |
| 12 | 0.46 | ○ | 0.05 | × | 6.7 | 2.31 | 1593 | × |

As shown in Tables 2 and 3, when surface roughness is within the specified range, no sticking in the annealing step was observed between the steel sheet or strip to each other.

On the other hand, sticking was observed between steel strips with less surface roughness as shown in Table 3.

(Ni-Plating)

Several samples with different thickness of nickel plating layer were produced under the following conditions.

Constituents of the Ni-Plating Bath $NiSO_4 \cdot 6H_2O$: 300 g/l $NiCl_2 \cdot 6H_2O$: 45 g/l Boric acid: 40 g/l Surfactant: 0.5 mg/l pH: 4.3

Current density: 5 A/dm2

Bath temperature: 55° C.

Quantity of electricity: 77 coulomb (Evaluation of Corrosion Resistance)

The corrosion resistance of the Ni-plated steel strip was evaluated by the following method. The results are listed in Tables 2 and 3.

The samples were preliminarily processed through the following steps for later evaluation of corrosion resistance. They were cleaned with trichloroethane, dried, and heat-treated (450° C. for ten minutes). Any rust was visually evaluated on the sample surfaces after testing under the following conditions.

Humidity: 95%

Temperature: 90° C.

Time: 40 hr

Testing equipment: Thermo-hydrostat

In Tables 2 and 3, ⊚ indicates samples with superior corrosion resistance, ○ indicates samples with corrosion resistance at the same level as of existing products, and x indicates samples with inferior corrosion resistance as compared with existing products.

The data proves that all the samples plated by the Ni layer with the thickness within the specified range of the present invention showed superior corrosion resistance.

(Annealing)

The samples were box-annealed at 620° C. for six hours. The gas atmosphere used was a mixture of 5.5% $H_2$ and 94.5% $N_2$.

Evaluation of Magnetic Characteristics

The magnetic characteristics after annealing were evaluated by the Simplified Epstein Method (Hm=10 Oe). The results are listed in Tables 2 and 3.

The Simplified Epstein Method measured magnetic characteristics in accordance with the electrical steel sheet or strip testing method (JIS C 2550).

Four 10 mm×100 mm specimens were set upon testing frames. Here, two specimens were parallel to the rolling direction and another two perpendicular to the rolling direction respectively. B–H hysteresis curves were measured to evaluate residual magnetism (Br), coercive force (Hc), and maximum permeability (μm). In this case, the Simplified Epstein analyzer of Riken electric Co., Ltd was used.

It may be seen from Tables 2 and 3 that the samples of the examples 1 through 6 have superior magnetic characteristics. However, the samples of comparative examples 9 through 12 are inferior. The examples 7 and 8 are shown in Table 4.

Annealing after the primary cold-rolling step facilitates the formation of a rougher surface during the secondary cold-rolling step. This prevents of the steel sheets or strips from sticking to each other during re-annealing after the Ni-plating step. The combination of two annealing steps improves the magnetic characteristics of the steel sheet or strip.

(Effect of the Present Invention)

In the present invention described above, inasmuch as no sticking is observed in steel sheets or strips with a surface roughness within the specified range, the steel sheets or strips can be used as superior inner-shield materials.

In the present invention, moreover, inasmuch as the Ni-plated steel sheet or strip has excellent corrosion resistance, the so-called blackening process conventionally used by color cathode ray tube manufacturers can be omitted. Thus, the present invention provides for economical inner-shield materials for use in color cathode ray tubes.

Furthermore, the inner-shield material produced according to the present invention has superior magnetic characteristics.

TABLE 4

| Sample | Annealing | Surface | Sticking | Ni plating | | Magnetic characteristics | | | |
|---|---|---|---|---|---|---|---|---|---|
| No. Example | Temp. (°C.) | roughness Ra (μm) | in annealing | thickness (μm) | Corrosion resistance | Br (KG) | Hc (Oe) | max. permeability | evaluation |
| 7 | 550 | 0.70 | ○ | 0.22 | ⊚ | 10.1 | 0.94 | 5025 | ⊚ |
| 8 | 680 | 2.06 | ○ | 0.37 | ⊚ | 10.3 | 0.97 | 4980 | ⊚ |

What we claimed is:

1. In a cathode ray tube having an inner shield material formed of a base steel sheet or strip, wherein the improvement comprises:

said base steel sheet or strip having a surface roughness in the range from about 0.2 to 2.0 μm Ra;

a nickel plating layer deposited on said base steel sheet or strip; said base steel sheet or strip and said nickel plating layer being annealed and recrystallized to provide crystal grain growth and enhanced magnetic characteristics; and a nickel-iron diffusion layer, formed by the annealing and recrystallization of said base steel sheet or strip having said nickel plating layer deposited thereon, to provide crystal grain growth and enhanced magnetic characteristics, wherein said deposited nickel plating layer has an initial thickness in the range from about 0.1 to 5.0 μm prior to forming said nickel-iron diffusion layer.

* * * * *